United States Patent [19]

Lindberg et al.

[11] 4,279,231

[45] Jul. 21, 1981

[54] APPARATUS FOR CONTROLLING THE AIR-FUEL RATIO IN AN INTERNAL COMBUSTION ENGINE

[75] Inventors: Allen W. Lindberg, Kirkwood; Thomas R. Gantzert, Florissant; Donald L. Hicks, St. Louis, all of Mo.

[73] Assignee: ACF Industries, Incorporated, New York, N.Y.

[21] Appl. No.: 92,121

[22] Filed: Nov. 7, 1979

Related U.S. Application Data

[63] Continuation of Ser. No. 767,914, Feb. 11, 1977, abandoned.

[51] Int. Cl.[3] ..... F02B 3/00; F02D 33/00

[52] U.S. Cl. ..... 123/489; 123/478

[58] Field of Search ..... 123/32 EA, 32 EE, 119 EC, 123/489, 478; 60/276, 285

[56] References Cited

U.S. PATENT DOCUMENTS

| | | | |
|---|---|---|---|
| 3,817,225 | 6/1974 | Priegel | 123/32 EA |
| 3,827,237 | 8/1974 | Linder et al. | 123/119 EC |
| 3,871,338 | 3/1975 | Schmidt et al. | 123/32 EA |
| 3,906,910 | 9/1975 | Szlaga, Jr. | 123/119 EC |
| 3,939,654 | 2/1976 | Creps | 60/276 |
| 4,077,364 | 3/1978 | Aoki | 123/32 EE |
| 4,089,313 | 5/1978 | Asano et al. | 123/32 EE |
| 4,096,834 | 6/1978 | Norimatsu et al. | 123/32 EE |
| 4,121,546 | 10/1978 | Hattori et al. | 123/32 EE |

*Primary Examiner*—P. S. Lall

*Attorney, Agent, or Firm*—J. Joseph Muller

[57] ABSTRACT

Apparatus for controlling the air-fuel ratio in an internal combustion engine to substantially maintain the ratio at a predetermined value while the engine is operating under various load conditions. The engine has a carburetor with an air passageway through which air is drawn into the engine. Fuel is supplied to the carburetor through a fuel system and mixed with air passing through the carburetor. The presence of oxygen in the combustion products, which is a function of the air-fuel ratio of the mixture, is sensed and a first electrical signal representative of the oxygen content is supplied. The first electrical signal is compared with a predetermined reference level which is a function of the predetermined value to produce a second electrical signal having first and second signal elements, a first signal element being produced when the air-fuel ratio of the mixture is greater than the predetermined level and a second signal element being produced when the ratio is less than the level. A control responsive to the second electrical signal supplies to an air metering unit a control signal by which the quantity of air introduced into the fuel system is controlled. A change in the control signal is produced whenever the second electrical signal has a transition from one signal element to the other thereby for the air metering unit to change the quantity of air introduced into the fuel system conduit by an amount necessary to substantially maintain the air-fuel ratio at the predetermined value.

13 Claims, 6 Drawing Figures

FF1
FF2
D
S
CC
R
Q
G1
G2
G3
G7
D1
D2
D9
Q1
Q2
+V
109
107
53
51
111
155
169
167
173
165
33
47
55
57
39
37
58
171

APPARATUS FOR CONTROLLING THE AIR-FUEL RATIO IN AN INTERNAL COMBUSTION ENGINE

This is a continuation, of application Ser. No. 767,914, filed Feb. 11, 1977, now abandoned.

BACKGROUND OF THE INVENTION

This invention relates to apparatus for controlling the operation of internal combustion engines and more particularly to apparatus for controlling the ratio of air to fuel in a mixture to be combusted in such an engine.

The control of emissions from internal combustion engines and particularly automobile engines has become a major environmental concern. Various federal and state regulatory agencies have promulgated emission standards for certain substances found in the combustion products entering the atmosphere through an engine's exhaust, the most important of these substances being hydrocarbons, carbon monoxide and oxides of nitrogen. To meet emission control standards, various pollution control devices such as catalytic converters and thermal reactors have been developed for use with automobile engines to reduce the quantities of unwanted substances emitted into the atmosphere to within prescribed limits.

It has been found that most efficient removal of unwanted substances by pollution control devices is achieved when an engine is operated within a narrow range of air-fuel ratio values for an air-fuel mixture combusted in an engine. Consequently, numerous systems have been developed which attempt to maintain the air-fuel ratio of a mixture to be combusted in an engine within this value range. Examples of systems of this type are disclosed in U.S. Pat. Nos. 3,939,654, 3,946,198, 3,949,551 and 3,963,009. While the systems disclosed in these patents do tend to keep the air-fuel ratio for a mixture to be combusted within the value range where maximum efficiency in removal is obtained, this is usually accomplished only by constantly adjusting the air-fuel ratio. Further, overadjustments frequently occur which then require additional corrections and the systems respond to transitory changes in an engine's operating characteristic to make adjustments when none are actually needed.

SUMMARY OF THE INVENTION

Among the several objects of the present invention may be noted the provision of apparatus for controlling the air-fuel ratio in an internal combustion engine; the provision of such apparatus for more precisely maintaining the air-fuel ratio at a predetermined value while the engine is operating under various load conditions; the provision of such apparatus for determining when an adjustment in the air-fuel ratio of a mixture to be combusted in the engine should be made to maintain the air-fuel ratio at the predetermined value; the provision of such apparatus for taking a "second look" at a present air-fuel ratio value before making any adjustment thereby to avoid constant adjustment of the air-fuel ratio and response to transient operating conditions; the provision of such apparatus which varies its response time as a function of whether the engine is operating under steady state or non-steady state conditions; the provision of such apparatus which adjusts the air-fuel ratio to a preset value when, for example, power is first supplied to the apparatus after its installation or after a power disruption; the provision of such apparatus in which the air-fuel ratio is maintained at its last adjusted value between the time the engine is shut down and the next time it is started; the provision of such apparatus which prevents an adjustment in the air-fuel ratio during an engine cold start and when the engine is operated in a certain manner, for example, at wide open throttle; the the provision of such apparatus which is compact in size and convenient to install and operates reliably.

Briefly, apparatus of the present invention controls the air-fuel ratio in an internal combustion engine to substantially maintain the ratio at a predetermined value while the engine is operating under various load conditions. The engine has a carburetor with at least one air passageway therein through which air is drawn into the engine and fuel from a source thereof is supplied to the carburetor through at least one fuel system and mixed with the air as it passes through the carburetor. The carburetor has a conduit through which air is introduced into the system and the engine further has a chamber for combustion of the resulting air-fuel mixture and means for exhausting the products of said combustion. The apparatus comprises means for metering the quantity of air introduced into the fuel system through the conduit thereby to control the air-fuel ratio of the mixture. The presence of oxygen in the products of combustion is sensed and a first electrical signal representative of the oxygen content therein is supplied, the oxygen content being a function of the air-fuel ratio of the mixture. The first electrical signal is compared with a predetermined reference level which is a function of the predetermined value to produce a second electrical signal having first and second signal elements, a first signal element being produced when the air-fuel ratio of the mixture is greater than the predetermined level and a second signal element being produced when the ratio is less than the level. A controller responsive to the second electrical signal supplies to the metering means a control signal by which the quantity of air introduced into the conduit is controlled and produces a change in the control signal whenever the second electrical signal has a transition from one signal element to the other thereby for the metering means to change the quantity of air introduced into the conduit by an amount necessary to substantially maintain the air-fuel ratio at the predetermined value. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
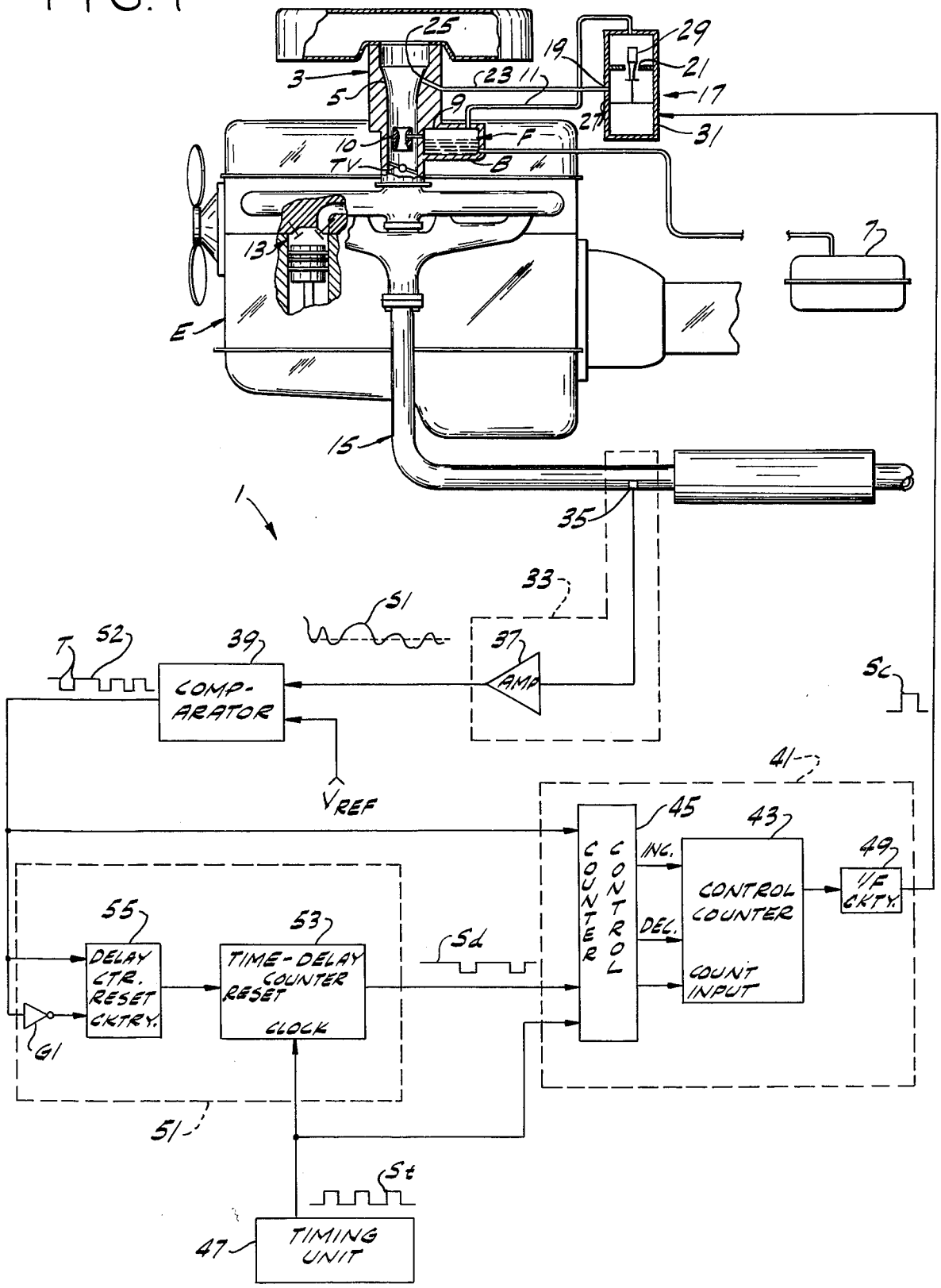
FIG. 1 is a block diagram of apparatus of the present invention for controlling the air-fuel ratio in an internal combustion engine.

Referring now to the drawings, apparatus of the present invention for controlling the air-fuel ratio in an internal-combustion engine E to substantially maintain the ratio of a predetermined value while the engine is operating under various load conditions is indicated generally at 1. Engine E has a carburetor 3 with an air passageway 5 through which air is drawn into the engine and fuel F from a source 7 is supplied to the carburetor through at least one fuel system 9 and mixed with air passing through the carburetor. The carburetor also has a throttle valve TV to control the flow rate of air through the carburetor and a venturi 10 by which a pressure differential is created so that fuel F is drawn through fuel system 9 and mixed with air to produce an air-fuel mixture, all as is well known in the art. Carburetor 3 further has a conduit 11 through which air is introduced into fuel system 9 as will be discussed. Engine E further has a chamber 13 for combustion of the resulting air-fuel mixture and an exhaust system 15 for exhausting the products of combustion.

An air metering unit generally indicated 17 meters the quantity of air introduced into fuel system 9 through conduit 11 to control the air-fuel ratio of the mixture. The unit has an air inlet 19 and an air outlet 21 which communicates with conduit 11. A portion of the air entering carburetor 3 through passageway 5 enters a conduit 23 via an opening 25 in the side of the passageway and enters air metering unit 17 through inlet 19. This air enters a chamber 27 in the metering unit and exits the chamber through outlet 21. Disposed in outlet 21 is a metering pin 29, which is a tapered metering pin and which is insertable into and withdrawable from the outlet to control the quantity of air admitted into conduit 11. The position of metering pin 29 in outlet 21 is controlled by a positioner 31. Withdrawal of metering pin 29 from outlet 21 by the positioner admits more air into conduit 11 while insertion of the metering pin into the outlet admits less air into the conduit. With more air flowing through conduit 11 and entering fuel system 9 there is a decrease in the flow rate of fuel through the system so that less fuel is mixed with air and the air-fuel ratio of the resulting mixture increases (i.e., the mixture becomes leaner). When less air enters fuel system 9 through conduit 11 the flow rate of fuel increases, more fuel is mixed with the air and the air-fuel ratio decreases (i.e., the mixture becomes richer). It will be understood that air metering unit 17 may be formed as part of carburetor 3 or may be a separate unit installed at a convenient location with respect to engine E and the carburetor.

Among the products of combustion exhausted through system 21 is free oxygen and the amount of this oxygen is a function of the air fuel ratio of the mixture combusted in chamber 13, i.e., the richer the mixture the less free oxygen is in the combustion products and the leaner the mixture the more free oxygen is present. The presence of oxygen in the products of combustion is sensed by an oxygen sensor 33 from which is supplied a first electrical signal S1 representative of the oxygen content. The dashed line REF shown in FIG. 1 represents the oxygen content in the products of combustion at the predetermined air-fuel ratio value. Sensor 33 includes a detector 35 positioned in the exhaust system and responsive to the oxygen content to generate a voltage whose amplitude is a function of the oxygen content and inversely related thereto, i.e., the more oxygen present in the exhaust system (the leaner the mixture) the lower is the amplitude of the generated voltage and vice versa. The detector may be a zirconia type detector or any other suitable oxygen detector. The voltage generated by detector 35 is amplified by an amplifier 37 to produce first electrical signal S1 which is an analog signal.

A comparator 39, which is a voltage comparator, compares first electrical signal S1 (the amplitude of the signal) with a predetermined reference level V ref. (a voltage level) which is a function of the predetermined air-fuel ratio value at which engine E is to operate to produce a second electrical signal S2 having first and second signal elements. A first signal element of the second electrical signal (a logic high) is produced when the air-fuel ratio of the mixture is greater than the predetermined level (the amplitude of signal S1 is less than the reference voltage level) and a second signal element (a logic low) is produced when the ratio is less than the value (the amplitude of signal S1 is greater than the reference voltage level). A transition T from one signal element to the other occurs whenever the amplitude of signal S1 changes from greater to less than the reference voltage amplitude and vice versa.

A controller 41 is responsive to second electrical signal S2 to supply to air metering unit 17, and specifically positioner 31 of the air metering unit, a control signal Sc by which the quantity of air introduced into conduit 11 is controlled. The controller includes a reversible accumulating control counter 43 and a counter control 45. The counter control is responsive to first and second signal elements of the second electrical signal to increment and decrement the contents of the control counter. The contents of the control counter are incremented when less air is to be introduced into conduit 11 and the air-fuel mixture made richer and decremented when more air is to be introduced into the conduit and the mixture made leaner. A timing unit 47 generates a timing signal St having a plurality of signal elements which are supplied to a count input of control counter 43, through counter control 45, to increment and decrement its contents. The contents of the control counter are incremented by elements of the timing signal when a first signal element of the second electrical signal is supplied to counter control 45 and decremented by timing signal elements when a second signal element of the second electrical signal is supplied to the counter control. Controller 41 further includes an interface circuit 49 to which control counter 43 supplies a digital signal representative of the value of its contents. Interface 49 is responsive to the digital signal to produce the control signal supplied to air metering unit 17. Controller 41 is responsive to the second electrical signal to produce a change in the control signal whenever the second electrical signal has a transition T from one signal element to the other, i.e., the contents of control counter 43 are incremented instead of decremented or vice versa. This results in a change in the digital signal supplied to interface 49 and in the control signal produced by the interface portion of the controller. A change in the control signal supplied to air metering unit 17 results in the air metering unit changing the quantity of air introduced into conduit 11 by an amount necessary to substantially maintain the air-fuel ratio at the predetermined value. Thus, a change in the control signal from controller 41 to positioner 31 of metering unit 17 produces a change in the position of metering pin 29 in outlet 21 and modulates the quantity of air introduced into fuel system 9. The air-fuel ratio of the mixture combusted in chamber 13 is thus varied and is driven toward the desired value.

Besides being supplied to controller 41, the second electrical signal is sampled by a sampler 51. This sampling occurs over a predetermined time interval starting when a signal element of the second electrical signal is produced and its purpose is to determine whether a transition between signal elements occurs within the time interval. Elements of timing signal St are supplied to sampler 51 which includes a time-delay counter 53 responsive to the timing signal elements for counting from zero to a preselected value which may, for example, be two and for inhibiting counter control 45 from incrementing or decrementing the contents of control counter 43 until the preselected value is reached. Delay counter 53 supplies first and second signal elements of a delay signal Sd to counter control 45. A first signal element of the delay signal is supplied to counter control 45 whenever the value of the contents of delay counter 53 is less than the preselected value and a second signal element of the delay signal is supplied to the counter control when the preselected count value is reached. When a first signal element is supplied to counter control 45, the counter control is inhibited for passing timing signal elements to control counter 43, as will be discussed, and the contents of the counter are unchanged. Only when a second signal element of the delay signal is supplied to counter control 45 is the contents of counter 43 incremented or decremented. Further, sampler 51 includes a delay counter reset circuit 55 responsive to each transition between signal elements of the second electrical signal to reset the value of the delay counter contents to zero. Consequently, if a transition between signal elements of the second electrical signal occurs within the predetermined time interval, i.e., before the count value of counter 53 reaches two, counter control 45 remains inhibited because it is still supplied with a first signal element of the delay signal and no change is produced in the contents of control counter 43 or in the control signal supplied to air metering unit 17. Thus, controller 41 is responsive to sampler 51 to produce a change in the control signal only if no transition between signal elements occurs within the predetermined time interval. If a transition does occur within the interval, no change in the control signal is produced and the quantity of air introduced into conduit 11 remains the same.

The importance of this sampling feature is that it prevents continuous adjustment of the air-fuel ratio of the combusted mixture. Thus, for example, momentary or transient changes which occur do not result in an adjustment, when none is actually needed, and eliminates the need for a second adjustment which would otherwise result when the transient change is over. By providing for a "second look" at the air-fuel ratio relative to the predetermined value before making an adjustment, the apparatus responds only to long term changes and makes an adjustment to the air-fuel ratio only when one is actually needed to return the ratio value to the point where the most efficient removal of substances from the exhaust products is accomplished as, for example, by a catalytic converter 56 in the engine's exhaust system.

Figure 3:
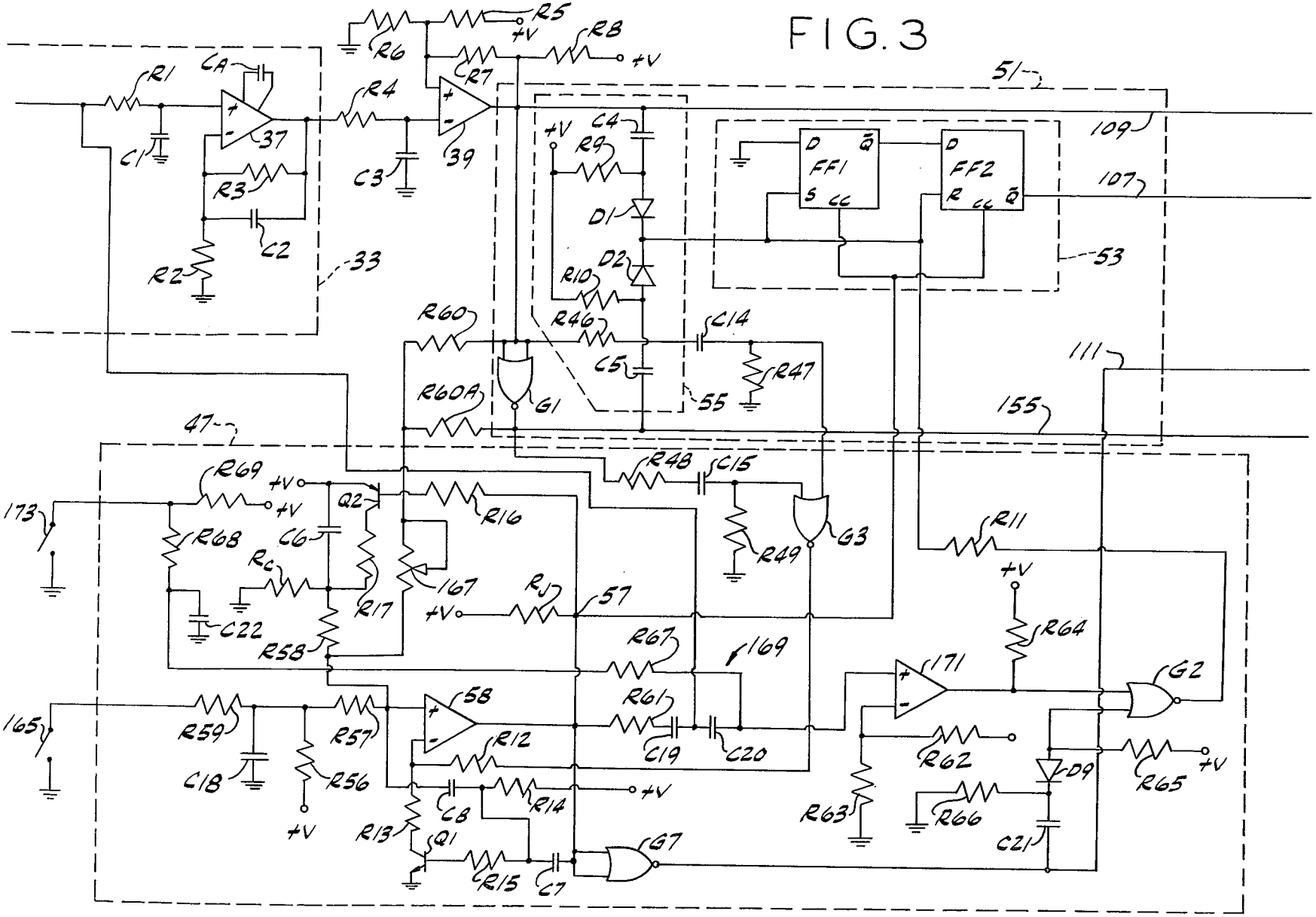
FIG. 3 is a schematic circuit diagram of a portion of the apparatus employed with either embodiment of the air metering unit.

Referring to FIG. 3, the voltage developed by detector 35 is supplied through a filter network comprised of a resistor R1 and a capacitor C1 and applied to one input (the non-inverting input) of amplifier 37 which is an operational amplifier and includes a capacitor CA. Preferably, the amplifier has a field-effect transistor (FET) input circuit which imposes a substantially zero current load on the detector. The amplifier gain is determined by a pair of resistors R2 and R3 and a feedback capacitor C2 and is, for example, five. From the output of amplifier 37 is supplied first electrical signal S1 which is applied to one input of comparator 39, the inverting input of an operational amplifier, through a filter network comprised of a resistor R4 and a capacitor C3. The comparator has a second input to which is applied the reference level V ref. This level is a voltage developed across a divider network comprised of a pair of resistors R5 and R6 and may, for example, represent the air-fuel ratio of the mixture at the stoichiometric point. The comparator circuitry further includes a feedback resistor R7 and a pull-up resistor R8. First and second signal element of the second electrical signal are supplied from the output of comparator 39. Because the first electrical signal is supplied to the inverting input of the comparator, a first signal element of the second electrical signal, a logic high, is produced when the amplitude of the first electrical signal is less than the reference voltage amplitude and a second signal element, a logic low, is produced when the amplitude of the first electrical signal exceeds the reference voltage amplitude.

Sampler 51, as noted, includes delay counter 53 and counter reset circuitry 55. Counter 53 is a two-stage binary counter comprised of a pair of flip-flops FF1 and FF2 respectively. The data input to flip-flop FF1 is grounded, while the data input of flip-flop FF2 is connected to the $\overline{Q}$ output of flip-flop FF1. Elements of delay signal Sd are supplied to counter control 45 from the $\overline{Q}$ output of flip-flop FF2. Counter reset circuitry 55 includes a pair of diodes D1 and D2 and a pair of R-C networks respectively comprised of a resistor R9 and a capacitor C4 and a resistor R10 and a capacitor C5. One side of capacitor C4 is connected to the output of comparator 39, while one side of capacitor C5 is connected to the output of a NOR gate G1 which serves to invert the second electrical signal supplied by comparator 39. The cathodes of diodes D1 and D2 are commonly connected and are tied to the set input of flip-flop FF1 and the reset input of flip-flop FF2. Further, the cathodes are connected through a resistor R11 to the output of a NOR gate G2, the function of which will be discussed. The resistance values of resistors R9 and R10 are each approximately one hundred times larger than that of resistor R11.

With the logic output of gate G2 low, each transition between signal elements of the second electrical signal results in a positive pulse being applied to the set input of flip-flop FF1 and the reset input of flip-flop FF2. An element of timing signal St supplied to the clock input of each flip-flop at this time results in the $\overline{Q}$ output of flip-flop FF1 going low and the $\overline{Q}$ output of flip-flop FF2 going high. This is the reset state of counter 53. When the next element of the timing signal is supplied to the clock inputs of the flip-flops, the $\overline{Q}$ output of flip-flop FF1 goes from low to high because the data input to the flip-flop is low. The $\overline{Q}$ output of flip-flop FF2 however remains high. When the next or second signal element of the timing signal is supplied to the clock inputs of the flip-flops, the $\overline{Q}$ output of flip-flop FF2 goes low because the data input to the flip-flop is now high. The $\overline{Q}$ output of flip-flop FF1 however remains high. Subsequent signal elements of the timing signal supplied to the clock input of the flip-flops do not effect a change in the $\overline{Q}$ output of either flip-flop unless the flip-flops are reset, in which instance the preceding sequence of events is repeated. A first signal element of the delay signal corresponds to the logic high at the $\overline{Q}$ output of flip-flop FF2 prior to a second timing signal element being supplied to the clock input of the flip-flops after delay counter 53 is reset. A second signal element of the delay signal corresponds to the logic low present at the $\overline{Q}$ output of flip-flop FF2 from the time the second timing signal element is supplied to the flip-flops, after the counter is reset, until the counter is again reset.

Elements of the timing signal generated by timing unit 47 and supplied to sampler 51 are developed at a junction point 57 within the timing unit. The timing unit includes a timing capacitor C6 and if this capacitor is assumed to be discharged, a voltage corresponding to a logic high is present at the junction and is supplied through a resistor Rj. Capacitor C6 is negatively charged through a resistor Rc and the charge level of the capacitor is applied to one input of a comparator 58 which is the non-inverting input of an operational amplifier. A reference voltage corresponding to a predetermined charge level of capacitor C6 is applied to a second input of the comparator (the inverting input of the amplifier), this voltage being developed across a divider network comprised of a pair of resistors R12 and R13 respectively when an NPN transistor Q1 is conducting and the logic output of a NOR gate G3 is high. Base voltage for transistor Q1 is supplied through a pair of resistors R14 and R15 respectively and with capacitor C6 discharged, the transistor conducts. Connected between capacitor C6 and electrical ground is a PNP transistor Q2 which is biased off when a logic high is present at junction 57. The output of comparator 58 is connected to the base of transistor Q2 through a resistor R16.

With capacitor C6 discharged, a logic high is supplied from the output of comparator 58 because the voltage level at the non-inverting input to the comparator, which corresponds to the capacitor charge level, exceeds the reference voltage. As capacitor C6 charges, this voltage level decreases and eventually falls below the reference level. When this occurs, the logic output of comparator 58 goes low driving junction 57 low. Transistor Q1 turns off because of coupling through a capacitor C7 to the low comparator output while transistor Q2 is biased into conduction. With transistor Q2 on, capacitor C6 discharges through a resistor R17. Positive feedback to the non-inverting input of comparator 58 through a capacitor C8 and capacitor C7, forces a complete high to low transition in the comparator output signal. This logic low is maintained while capacitor C7 charges and transistor Q1 is switched back into conduction. Capacitor C6 fully discharges during this period and when transistor Q1 again conducts the reference level is again applied to the inverting input of comparator 58 causing a transition at the comparator output from a logic low to high. This takes transistor Q2 out of conduction and capacitor C6 starts charging again. At junction 57, a negative going pulse of signal element of the timing signal has been produced and supplied to the clock inputs of flip-flops FF1 and FF2.

Figures 2A, 2B:
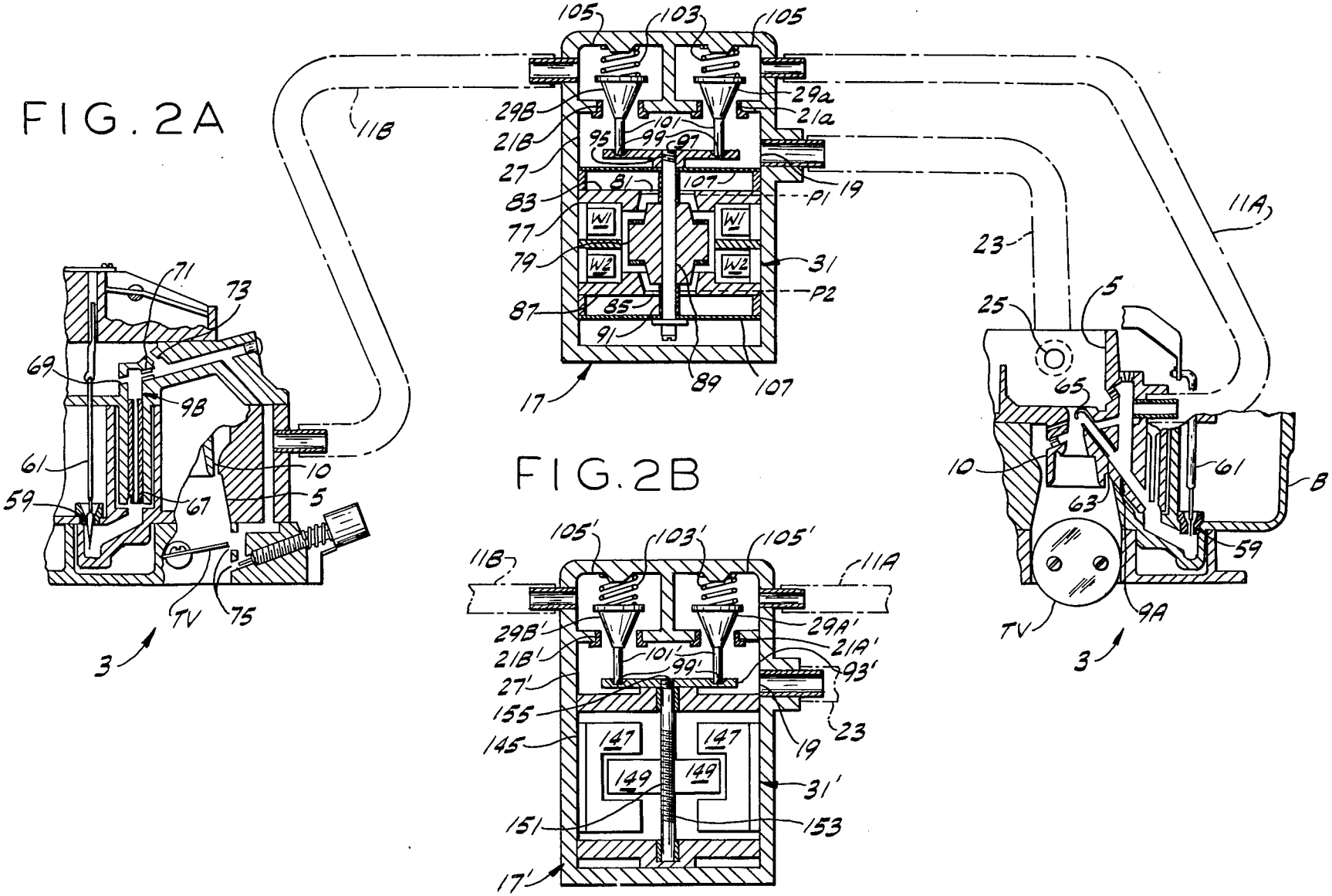
FIG. 2A is a sectional view of a carburetor illustrating the low and high speed circuits of the carburetor and a sectional view of a first embodiment of an air metering unit of the apparatus of the present invention.
FIG. 2B is a sectional view of a second embodiment of an air metering unit of the apparatus of the present invention.
Figure 4:
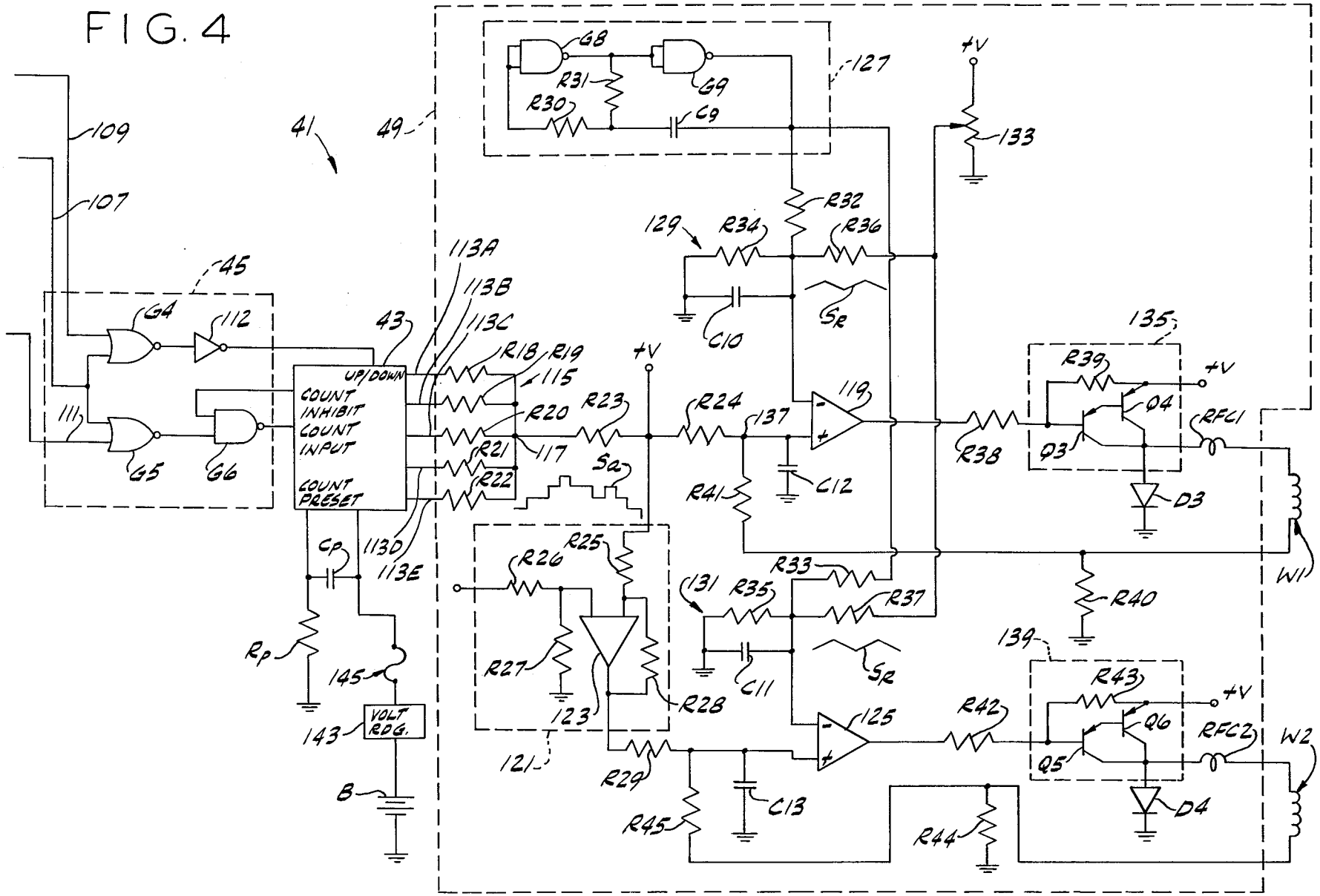
FIG. 4 is a schematic circuit diagram of controller circuitry of the apparatus for use with the first embodiment of the air metering unit.

Referring now to FIGS. 2A and 4, a first embodiment of air metering unit 17 is shown (FIG. 2A) together with the controller 41 circuitry (FIG. 4) used with the unit. As shown in FIG. 2A, carburetor 3 contains two fuel supply systems, a high-speed (main) system 9A and a low-speed (idle) system 9B. In high-speed system 9A, fuel flows from a bowl B through a metering jet 59 and the flow rate of fuel is controlled by a tapered metering rod 61 positioned in the jet by throttle TV. Fuel metered through jet 59 enters a well 63 from which it is drawn into passageway 5 through a nozzle 65. In low-speed system 9B, fuel leaving jet 59 enters the system through a low-speed jet 67. The fuel is then mixed with air entering the system at an air bleed 69 and the mixture is accelerated through a restriction 71 and mixed with more bleed air entering the system through an air bleed 73. The resultant mixture is discharged into passageway 5 through idle ports 75 which are located downstream from closed throttle Tv.

For a carburetor 3 as shown in FIG. 2*a*, air metering unit 17 has two air outlets, 21A and 21B respectively, one for each fuel system and a metering pin 29A and 29B is disposed in the respective outlets. Outlet 21A communicates with a conduit 11A by which air is introduced into fuel system 9A and outlet 21B communicates with a conduit 11B by which air is introduced into fuel system 9B. Air flowing through conduit 11A enters fuel system 9A at a point above the fuel level in well 63. The effect of varying the quantity of air entering system 9A through the conduit is to modulate, in effect, the vacuum pressure on the fuel and thus vary the quantity of fuel delivered through nozzle 65. Air flowing through conduit 11B enters fuel system 9B between restriction 71 and idle ports 75. Varying the quantity of air entering system 9B through conduit 11B modulates the vacuum pressure at low-speed jet 67 and this controls the quantity of fuel mixed with bleed air. Metering pins 29A and 29B are both tapered and each is insertable into and withdrawable from its respective air outlet. Positioner 31 of metering unit 17 simultaneously positions both metering pins in their respective air outlets in response to the control signal supplied to the positioner from controller 41. It will be understood that while the same quantity of air may be introduced into fuel systems 9A and 9B through conduits 11A and 11B, the flow rate of air through the respective conduits is dependent upon which carburetor circuit is in use at any one time.

The positioner 31 shown in FIG. 2A includes a variable position solenoid 77 having at least one and preferably two windings, W1 and W2 respectively, to which the control signal is supplied. The solenoid further has an armature 79 movable in either of two directions between a first position P1 representative of a first value of the contents of control counter 43 and a second position P2 representative of a second value of the control counter contents. Position P1 corresponds to the dashed line position shown in FIG. 2A in which the upper end of armature 79 contacts a stop 81 formed on the inner surface of a pole piece 83, while position P2 corresponds to the dashed line position in FIG. 2A in which the lower end of armature 79 contacts a stop 85 formed on the inner surface of a pole piece 87. Armature 79 has a longitudinal central bore 89 in which is inserted a shaft 91 threaded at each end. A plate 93 has a central threaded bore 95 and is mounted on one end 97 of shaft 91. Thus, plate 93 is movable with armature 79 as the armature moves between first and second positions P1 and P2. A pair of sockets 99 are formed in the upper face of plate 93 and each metering pin has a stem 101 whose free end fits into one of these sockets. A spring 103 is positioned between each metering pin and a wall 105 of metering unit 17 to bias the pins toward a position to close the outlet in which each is disposed. Outwardly of each pole piece 83 and 87 is a scroll spring 107 having a central bore 109 in which shaft 91 is disposed. The scroll springs are made of a thin, resilient disk-shaped material which is flexible in either direction depending upon the position of armature 79 and shaft 91. Each spring has a portion cut away during its manufacture and the cuts are made in a predetermined pattern so as armature 79 and shaft 91 move in one direction or the other between positions P1 and P2, when a change in the control signal supplied to windings W1 and W2 occurs, the movement is linear and each movement is for an incremental distance between the two positions.

Referring to FIG. 4, counter control 45 of controller 41 includes a pair of NOR gates G4 and G5 and a NAND gate G6. The delay signal supplied by delay counter 53 is provided to one input of gages G4 and G5 on a line 107. The first and second signal elements of second electrical signal S2 are supplied to a second input of gate G4 on a line 109, while elements of timing signal St are supplied on a line 111 to a second input of gate G5 through a NOR gate G7 (see FIG. 3) which acts as an inverter. The output of gate G5 is connected to one input of gate G6 and the output of gate G6 is connected to the count input of counter 43. Control counter 43 is a five-stage binary counter whose contents may vary between a value of zero and thirty-one and armature 79 is thus movable to any of thirty-two discrete positions depending upon the value of the control counter contents. The position P1 which armature 79 of variable position solenoid 77 may attain corresponds to the zero value while the position P2 corresponds to the value thirty-one. The logic output from gate G4 is supplied to an up/down input of the counter through an inverter 112 and the logic level supplied to this input determines whether the counter contents are incremented or decremented, the contents being incremented when a logic high is supplied to the input and decremented when a logic low is supplied to the input. Counter 43 has an inhibit output which is connected to a second input of gate G6 for reasons to be discussed.

As previously indicated, a first signal element of delay signal Sd is supplied by delay counter 53 to counter control 45 so long as the value of its contents is less than two. When this signal element (a logic high) is supplied to gate G5, the logic output of the gate is held low and passage of timing signal elements to counter 43 is inhibited. When a second signal element of the delay signal (a logic low) is supplied to gate G5, elements of the timing signal are passed to gate G6. If the value of the contents of control counter 43 is less than thirty-one, when the counter is being incremented, or more than zero when the counter is being decremented, the input signal to gate G6 from the inhibit output of counter 43 is a logic high and timing signal elements are passed to the count input of the counter. As the contents of counter 43 change, the digital signal output of the counter changes. This signal is supplied on lines 113A through 113E to interface circuitry 49 and more specifically, to a digital-to-analog converter 115. The digital-to-analog converter is comprised of resistors R18, R19, R20, R21 and R22 and produces an analog signal Sa at a summing point 117. The amplitude of the analog signal is a function of the value of the contents of counter 43 and is increased a predetermined amount each time the contents of counter 43 are incremented, decreased by the same predetermined amount each time the counter contents are decremented and remains the same so long as sampler 51 inhibits the supply of timing signal elements to counter control 45.

The analog signal produced at summing point 117 is supplied through a current limiting resistor R23 and a resistor R24 to one input of a comparator 119, the non-inverting input of an operational amplifier. The analog signal is further supplied to a unity gain inverting amplifier 121 which includes an operational amplifier 123, an input resistor R24, a pair of resistors R26 and R27 which form a voltage divider and a feedback resistor R28. The inverted analog signal supplied at the output of amplifier 121 is applied through a resistor R29 to one input of a comparator 125, also the non-inverting input of an operational amplifier.

Comparators 119 and 125 compare the amplitude of the analog signal supplied thereto with the amplitude of a reference signal Sr to produce first and second signal elements of the control signal which are supplied to windings W1 and W2 of solenoid 77. A fixed-frequency square-wave generator 127 produces a square-wave signal. The generator is comprised of a pair of NAND gates G8 and G9, a pair of resistors R30 and R31 and a capacitor C9 and operates, as is well known in the art, to produce a square wave at a frequency which is, for example 1 KHz. The square-wave output of generator 127 is supplied through a resistor R32 and a resistor R33 to a pair of integrating circuits generally indicated 129 and 131 respectively. Integrating circuit 129 consists of a resistor R34 and a capacitor C10 while integrating circuit 131 consists of a resistor R35 and a capacitor C11. The output of each circuit is reference signal Sr, which has a triangular waveform, and this signal is supplied to the inverting input of comparators 119 and 125. Further, the reference signal supplied to each comparator is superimposed on a bias voltage level produced by a potentiometer 133 and applied to the respective reference signal input paths via a resistor R36 and a resistor R37. The setting of potentiometer 133 is such that the bias voltage level on which the reference signal is superimposed is approximately one-half the voltage corresponding to the difference between a logic high and a logic low.

Elements of the control signal supplied at the output of comparator 119 are supplied to a driver circuit 135 through a resistor R38. Driver circuit 135 includes a pair of PNP transistors Q3 and Q4 and a bias resistor R39 and the output of the driver circuit is connected to winding W1 of solenoid 77 through a radio-frequency choke RFC1. A pair of resistors R40 and R41 and a capacitor C12 form a negative feedback circuit by which the amount of current flowing in winding W1 is sensed and a signal indicative thereof provided to a summing point 137. Elements of the control signal from comparator 125 are supplied to a driver circuit 139 through a resistor R42. Driver circuit 139 comprises a pair of PNP transistors Q5 and Q6 and a bias resistor R43. The output of the driver circuit is connected to winding W2 through a radio-frequency choke RFC 2 and a pair of resistors R44 and R45 and a capacitor C13 form a negative feedback circuit by which the current flowing in winding W2 is sensed and a signal indicative thereof supplied to a summing point 141. Each driver circuit has a diode, D3 and D4 respectively, connected between its output and electrical ground. These diodes shunt voltage spikes induced in windings W1 or W2 when a second signal element of the control signal, a low voltage level, is supplied to a winding and a magnetic field previously induced in the winding collapses.

Operation of the apparatus is as follows:

Assume that the amount of oxygen in exhaust system 15 is increasing, indicating that the air-fuel ratio of the mixture is increasing or that the mixture is getting leaner. For this condition, the amplitude of first electrical signal S1 is decreasing and this amplitude is compared with reference level Vref by comparator 39. If the amplitude of signal S1 is initially greater than the reference level amplitude, it eventually falls below that level as the mixture keeps getting leaner. When the reference level amplitude is passed, a transition T in second electrical signal S2 occurs and the comparator 39 output goes from low to high and a first rather than a second signal element of second electrical signal S2 is produced. This logic high is supplied on line 109 to gate G4 of counter control 45 and to delay counter reset circuitry 55.

The logic high from comparator 39 is inverted to a low by gate G1 and is also supplied through a current limiting resistor R46 and a R-C network comprised of a resistor R47 and a capacitor C14 to one input of gate G3. The other input to gate G3 is the inverted output of comparator 39 which is supplied to the gate through a resistor R48 and a R-C network including a resistor R49 and a capacitor C15. A logic high to either input of gate G3 momentarily forces the gate output low and, as previously discussed, the logic output from gate G3 is supplied to the inverting input of comparator 58. By forcing the logic output of gate G3 momentarily low, comparator 58 is forced to supply a logic high at its output regardless of the level to which capacitor C6 is charged, and this prevents capacitor C6 from discharging since transistor Q2 is kept in its non-conducting state. Thus, the generation of timing signal elements is momentarily inhibited. After a predetermined period established by the time-constant of the R-C networks, the logic output of gate G3 goes high and timing signal elements are again generated. Gate G3 therefore synchronizes the supply of timing signal elements to sampling network 51 and controller 41 with the random occurrence of transitions between signal elements of the second electrical signal.

Delay counter 53 is reset via reset circuitry 55 upon occurrence of the transition, as previously discussed, and a first signal element (a logic high) of delay signal Sd is supplied on line 107 to gates G4 and G5. This high inhibits gate G5 from passing timing signal elements supplied to it on line 111. If the amplitude of signal S1 does not rise above that of reference level Vref prior to two consecutive timing signal elements being supplied to delay counter 53 after it is reset, the counter output changes from a first to a second signal element of the delay signal. Gate G4 now has a logic high and a logic low applied to its inputs and a logic high is supplied to the up/down input of control counter 53 from inverter 112 signifying that the contents of the counter are to be incremented. Gate G5 is now supplied a logic low on line 107 and passes each timing signal element supplied to it. If the value of the contents of counter 43 is less than thirty-one, the input to gate G6 from the count inhibit output of the counter is high and gate G6 passes the timing signal elements to the count input of the counter.

Each timing signal element received by counter 43 at its count input results in the contents of the counter being increased by one. If a logic low were being supplied to the up/down input of the counter, its contents would be decreased by one for each timing signal element received. Each time the contents of counter 43 are incremented, the composition of the digital signal supplied to interface 49 changes and each change results in a step increase in the amplitude of analog signal Sa produced at summing point 117 and supplied to comparators 119 and 125.

The signal applied to the non-inverting input of comparators 119 and 125 is a function of the analog signal amplitude and the current presently flowing in windings W1 and W2 of solenoid 77. This input signal is developed at the respective summing points 137 and 141. The current flowing in the solenoid windings is determined by the amount of time a first signal element of the control signal is supplied to each winding as compared to a second signal element of the control signal and this, in turn, is a function of the amount of time within each cycle of the reference signal that the analog signal amplitude exceeds the reference signal amplitude. With the contents of counter 43 at one value, the analog signal amplitude is a level which exceeds the reference signal amplitude for a certain portion of each reference signal cycle. This results in driver circuits 135 and 139 each being on for a portion of each cycle and a current flows through each winding and induces a magnetic field whose force holds armature 79 at a position between positions P1 and P2. As previously discussed, the position of metering pins 29A and 29B in their respective outlets is determined by the armature position as is the quantity of air admitted into conduits 11A and 11B.

With an increase in the analog signal amplitude, there is an increase in the voltage level at the non-inverting input to comparator 119 and a decrease in the voltage level at the non-inverting input to comparator 125. This latter is because of the signal inversion by amplifier 121. The potentiometer 133 setting and the values of resistors R36 and R37 are such that when the value of the contents of counter 43 are at their mid-range value, the input level to both comparators is equal. For this condition each comparator supplies a control signal to respective windings W1 and W2 in which the length of time a first signal element is supplied to the winding during a reference signal cycle is equal to the length of time a second signal element is supplied to the winding.

With the increase at the non-inverting input to comparator 119, the input amplitude momentarily exceeds the reference signal amplitude throughout the reference signal cycle and a first element of the control signal is continuously supplied to winding W1. This results in an increase in the average current flowing through the winding and this increase is reflected at junction 137 through the comparator 119 feedback circuit. An increase in the average current flow results in a decrease in the voltage level input to the comparator so that the analog signal amplitude begins to fall and again exceeds the reference signal amplitude for only a portion of each reference signal cycle. Finally, a steady state condition is reached in which a first signal element of the control signal is supplied to winding W1 for a greater portion of each reference signal cycle than before the increase in the analog signal amplitude. This portion continues to increase as long as the contents of control counter 43 are incremented.

The opposite occurs at comparator 125 in which the increase in analog signal amplitude results in the reference signal amplitude exeeding the analog signal amplitude throughout a reference signal cycle. As a consequence, no current is supplied to winding W2 and the average winding current decreases. This is reflected at junction point 141 as an increase in the voltage level input to comparator 125 and the analog signal amplitude again exceeding the reference signal amplitude for part of each cycle. Finally, a steady state condition is reached in which first and second signal elements of the control signal are supplied to winding W2 in a new ratio with the second signal element being supplied for a longer period of each reference signal cycle than was the case prior to the analog signal amplitude increase. The net result of these changes is the movement of armature 77 one step closer to position P2 and insertion of the metering pins into their respective outlets and enrichment of the air-fuel mixture.

It will be understood that if the contents of counter 43 are decremented, the reverse of the situation above described would occur. That is, a step decrease in the analog signal amplitude results in signal elements of the control signal being supplied to winding W1 with the portion of time a first signal element is supplied to the winding compared to a second signal element being less than before the decrease, while for the control signal supplied to winding W2 the portion increases. Armature 79 thus moves one step closer to position P1 and the metering pins are withdrawn from their outlets and the air-fuel mixture is leaned.

The supply of timing signal elements to controller 41 and the resultant change in position of armature 79 and metering pins 29A and 29B continues until the amplitude of first electrical signal S1 crosses reference Ref. This, as described, produces a transition between signal elements of second electrical signal S2 and delay counter reset circuitry 55 responds to the transition to reset delay counter 53 and terminate the supply of a second signal element of the delay signal to counter control 45 and supplies a first signal element instead. This inhibits counter control 45 from supplying any further timing signal elements to control counter 43.

It is important for proper operation of the apparatus that the value of the contents of counter 43 not exceed a maximum value when the counter is being incremented or a minimum value when the counter is being decremented. If, for example, the value of the counter contents is thirty-one and the counter is being incremented, the next timing signal element supplied to the counter results in the capacity of the counter being exceeded and the digital signal on lines 113A to 113E representing a zero. Were the capacity to be exceeded, armature 79, which is at position P2 for a count value of thirty-one would be driven to position P1. More air would be introduced into conduits 11A and 11B and the air-fuel mixture would be leaned. This, however, is the condition trying to be remedied and as a result is only made worse. The reverse is true when the counter is being decremented and the value of its contents reaches zero. To prevent this from happening, counter 43 supplies a logic low to gate G6 whenever one of the two conditions occurs and this inhibits gate G6 from passing timing signal elements to the count input of the counter. This logic low remains until the direction of counting of the counter's contents changes or until an adjustment in the carburetion is made and the value of the counter contents is set to a preset value.

The contents of counter 43 are forced to a preset value whenever power is first applied to the counter. This occurs, for example, when power is first supplied to the apparatus after its installation or when power is first applied to the apparatus after power disruption. An R-C circuit comprised of a capacitor $C_p$ and a resistor $R_p$ produces a momentary logic high at the preset input of the counter and this sets the value of the counter contents to a mid-range value. Setting the contents of counter 43 to the preset value results in the air-fuel ratio being adjusted to a mid-range value. Additionally, voltage from a power source, for example, an automobile battery B, is continuously supplied to the counter when the engine is shut down to maintain the value of the counter contents at the last value attained prior to engine shutdown. This is accomplished, for example, by regulating the battery voltage by a regulator 143 and supplying the regulated voltage output to counter 43 through a clock-fuse circuit generally indicated at 145 which is closed even when engine E is shut down. By maintaining the value of the counter contents at their last attained value, the air-fuel ratio of the mixture has approximately the same value it previously had when the engine is restarted. This helps improve pollution control when the engine is restarted especially when an automobile in which engine E is placed is driven from one part of the country to another where altitude and other atmospheric conditions have a different effect on the air-fuel ratio than the conditions at the previous location.

Figure 5:
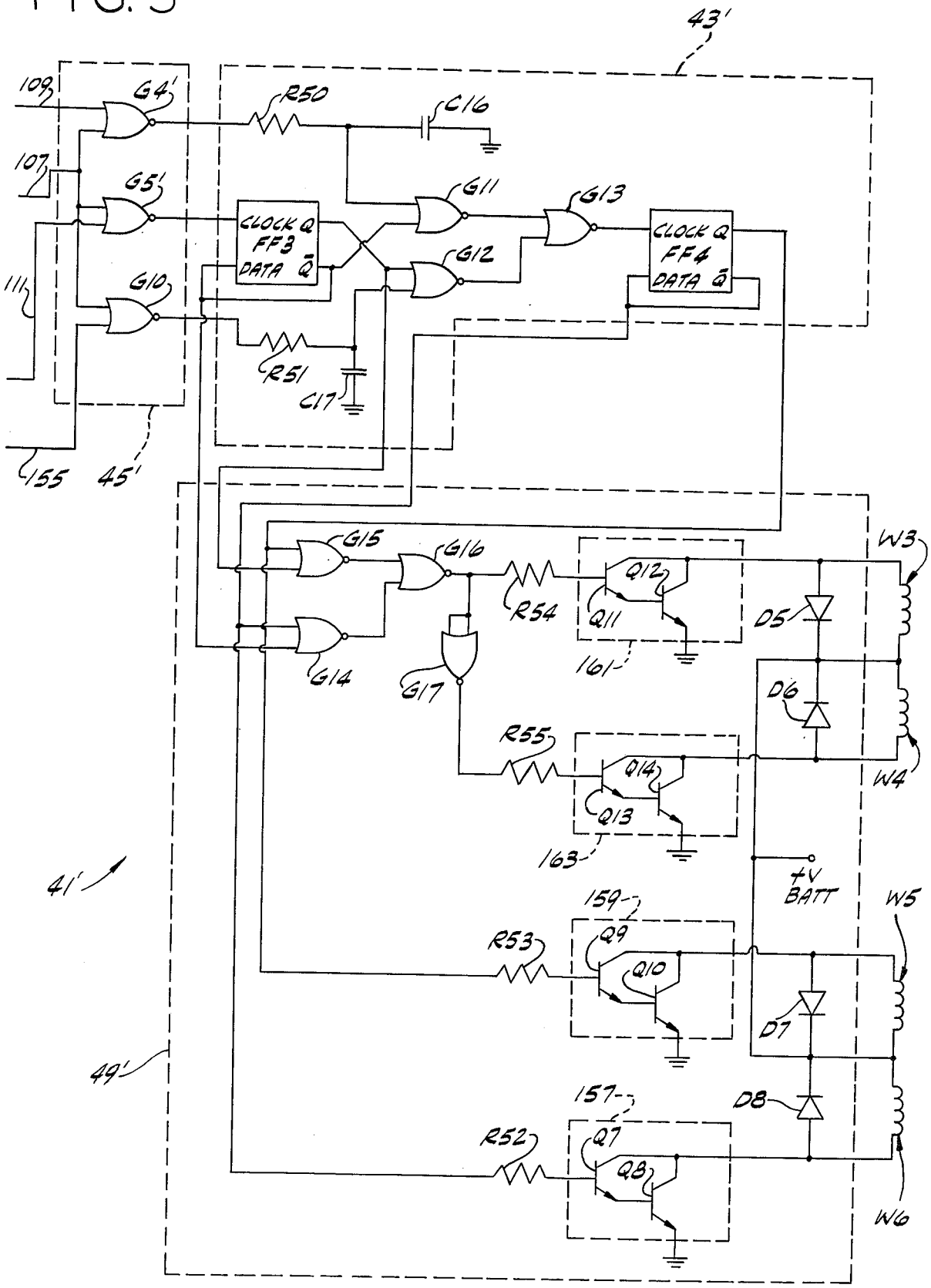
FIG. 5 is a schematic circuit diagram of controller circuitry of the apparatus for use with the second embodiment of the air metering unit.

Referring now to FIGS. 2B and 5, a second embodiment of the air metering unit, designated 17', is shown (FIG. 2B) as is a controller 41' (FIG. 5) for this second embodiment. Air metering unit 17' has two air outlets 21A' and 21B' with metering pins 29A' and 29B' respectively positioned in the outlets. The air metering unit further has a positioner 31' for inserting the metering pins into or withdrawing them from their respective air outlets. Positioner 31' comprises a stepper motor 145 having a stator 147 comprised of a plurality of phase displaced windings, for example the four sets W3, W4, W5 and W6 of windings represented in FIG. 5. The stepper motor also has a rotor 149 rotatable in either of two directions and the rotor has a longitudinal threaded bore 151 through its center. A threaded shaft 153 is received in bore 151 for longitudinal movement in one of two directions depending upon the direction of rotor rotation. A plate 93' is affixed to end 155 of shaft 153 and metering pins 29A' and 29B' are attached to the plate. A pair of sockets 99' are formed in the upper face of plate 93' and each metering pin has a stem 101' whose free end fits into one of these sockets. A spring 103' is positioned between each metering pin and a wall 105' of the air metering unit to bias the metering pins to close their associated outlets.

Controller 41' includes a pair of NOR gates G4' and G5' and a NOR gate G10. One input of each gate is supplied with signal elements of the delay signal on line 107 and gate G4' has a second input supplied with signal elements of second electrical signal S2 on line 109. Gate G5' has a second input supplied with timing signal elements on line 111 and gate G10 has a second input supplied with the output signal from inverter G1 on a line 155, the signal being the inverse of the second electrical signal. Controller 41' has a control counter 43', which is a two-stage binary counter comprised of a pair of flip-flops FF3 and FF4, respectively and three NOR gates G11, G12 and G13. The output of Gate G5' is connected to the clock input of flip-flop FF3 while the output of gate G4' is connected to one input of gate G11 through an R-C network consisting of a resistor R50 and a capacitor C16. The output of gate G10 is connected to one input of gate G12 through an R-C network comprised of a resistor R51 and a capacitor C17. The $\bar{Q}$ output of flip-flop FF3 is connected to a second input of gate G11, to the data input of the flip-flop and to one input of a NOR gate G14 in interface circuit 49'. The Q output of the flip-flop is connected to a second input of gate G12 and to one input of a NOR gate G15 in the interface circuit. The outputs of gates G11 and G12 are connected to inputs of gate G13 and the output of the gate is connected to the clock input of flip-flop FF4. The $\bar{Q}$ output of flip-flop FF4 is connected to its data input, to a second input of gate G14, and through a resistor R52 to a driver circuit 157 which is comprised of a pair of NPN transistors Q7 and Q8. The Q output of the flip-flop is connected to a second input of gate G15 and through a resistor R53 to a driver circuit 159 comprised of a pair of NPN transistors Q9 and Q10. The outputs of gates G14 and G15 are connected to inputs of a NOR gate G16 and the output of gate G16 is connected to both inputs of a NOR gate G17 and through a resistor R54 to a driver circuit 161 consisting of a pair of NPN transistors Q11 and Q12. The output of gate G17 is connected through a resistor R55 to a driver circuit 163 comprised of a pair of NPN transistors Q13 and Q14.

The circuitry of interface 49' supplies the control signal to the windings of stator 147 in a first sequence when the contents of control counter 43' are incremented to produce a positive phase rotation of stepper motor 145 and movement of shaft 153 in the direction to insert metering pins 29A' and 29B' into their respective air outlets. Less air is the introduced into conduits 11A and 11B and the air-fuel mixture is enriched. Interface 49' supplies the control signal to the windings in a second sequence when the counter contents are decremented to produce a negative phase rotation of the stepper motor and movement of shaft 153 in the direction to withdraw the metering pins from their respective air outlets. More air is then introduced into the conduits and the air-fuel mixture is leaned. The four sets of stator windings are phase-displaced ninety electrical degrees apart and the sequencing logic of interface 49' supplies the control signal to two of the four sets of windings at any one time, the two sets to which the control signal is supplied being determined by the value of the contents of control counter 43' and changing as the contents are incremented or decremented. The windings W3–W6 are arranged such that winding W3 represents a first phase corresponding to 90°, winding W4 a second phase corresponding to 270°, winding W5 a third phase corresponding to 180°, and winding W6 a fourth phase corresponding to 0°. Further, stepper motor 145 may, for example, have twelve pole pairs. As a consequence, the supply of the control signal to two of the windings produces a resultant magnetic field which moves rotor 149 in 15° steps, the direction of movement depending upon whether the contents of counter 43' are incremented or decremented.

Consider, as in the previous example, the situation where the air-fuel mixture is too lean and is to be enriched. For this condition, a first signal element (a logic high) of the second electrical signal is supplied to gate G4' on line 109 and the inverse of the signal element (a logic low) to gate G10 on line 155. When a second signal element (a logic low) of the delay signal is supplied on line 111 from delay counter 53, the logic output of gate G4' is low and that of gate G10 high.

If the value of the contents of control counter 43' is presumed to be zero, flip-flops FF3 and FF4 each supply a logic high at their $\bar{Q}$ outputs and a logic low at their Q outputs. Gates G11 and G12 each have a high and low input and supply a logic low to gate G13 which, in turn, supplies a logic high to the clock input of flip-flop FF4. When the next timing signal element is supplied to gate G5', it is passed by the gate to the clock input of flip-flop FF3 triggering the flip-flop. The Q output of the flip-flop goes high and its $\bar{Q}$ output low. Gate 11 now has both inputs low and supplies a logic high to gate G13, and gate G12 has both inputs high and supplies a logic low to gate G13. The output supplied by gate G13 goes low but this transition does not trigger flip-flop FF4 whose logic output remains Q high, $\bar{Q}$ low.

At interface 49', gate G14 has a high and a low input and gate G15 has both inputs high; and the gates both supply a logic low to gate G16. The logic output of gate G16 is high and turns on driver circuit 161 so that the control signal is supplied to winding W3. At the same time, driver circuit 157 is turned on by the logic high at the $\bar{Q}$ output of flip-flop FF4 and the control signal is supplied to winding W6. The supply of the control signal to windings W3 and W6 produces a magnetic field by which rotor 149 is, for example, rotated from a 0° position to a 15° position.

When the next timing signal element is passed by gate G5' to flip-flop FF3, the Q output of the flip-flop goes low and its $\bar{Q}$ output high. Gates G11 and G12 again each have a high and a low input and supply a logic low to gate G13 whose output now goes high, triggering flip-flop FF4. The Q output of flip-flop FF4 goes high and its $\bar{Q}$ output low. The value of the contents of counter 43' now represents two. With the logic outputs of flip-flops FF3 and FF4 as indicated, driver circuit 161 is on and the control signal is supplied to winding W3 and driver circuit 159 is on and the control signal is supplied to winding W5. The resultant field produced in stepper motor 145 moves rotor 149 from its 15° position to a 30° position.

If timing signal elements continue to be supplied to counter 43', i.e., delay counter 53 is not reset, the value of the contents of counter 43' goes to three and then back to zero. For a value of three, driver circuits 163 and 159 are on and the control signal is supplied to windings W4 and W5. For a value of zero, driver circuits 163 and 157 are on and the control signal is supplied to windings W4 and W6. In each instance, a magnetic vector is produced in stepper motor 145 which produces another 15° of rotor 149 rotation.

The value of the contents of counter 43' continues the cycle of 0, 1, 2, 3, 0, etc. as the counter is incremented. This is unlike the operation of control counter 43 discussed previously in which the contents of the counter cannot exceed a maximum or a minimum value. If counter 43' were decremented, the value of the contents cycles 0, 3, 2, 1, 0 etc., so that the contents of counter 43' cycle in a first sequence of count values when the counter is incremented and in a second and opposite sequence of count values when the counter is decremented.

It will be understood that the rotation of rotor 149 when counter 43' is decremented is opposite to that produced when the counter is incremented, because the control signals are supplied to two of the four windings of stator 147 in a reverse sequence to that in which they are supplied when the counter is incremented. In either instance, energy induced in the windings when the control signal is supplied to them is given off when the control signal is removed. To prevent damage which might occur because of the resultant voltage surge, clamping diodes D5, D6, D7 and D8 are connected across the respective windings W3–W6. Also, as with control counter 43, voltage is continuously supplied to control counter 43' even when engine E is shut down, thus for the counter contents to be at the last value attained prior to engine shutdown when the engine is restarted.

Timing unit 47 generates timing signal elements at a first repetition rate when engine E is operting under steady state conditions and at a second and faster repetition rate when a non-steady state condition is created such as when the engine accelerates or decelerates. The operation of timing unit 47 to generate timing signal elements at the first repetition rate which is, for example 1.5 Hz, has been previously described, and involves charging timing capacitor C6 and comparing the charge level of the capacitor with a reference voltage level by comparator 58 and discharging the capacitor when the reference level is reached. When steady state operation of the engine chages, it is reflected, for example, by a change in engine manifold pressure. A switch 165 is positioned in the manifold and is responsive to pressure changes which occur when a non-steady state condition is created to close and remain closed until a new steady state condition is reached.

When a steady state condition exists, a capacitor C18 is charged through a resistor R56. As timing capacitor C6 charges, current flows through a pair of resistors R57 and R58, which form a divider network, and resistor Rc to ground. Current flow through this path has the effect of reducing the charge rate of capacitor C6 by decreasing the capacitor charge current. When a non-steady state condition is created, a resistor R59 is connected to ground through closed switch 165. The flow of current through the divider network is reversed and this effectively increases the charge current of capacitor C6, so that the capacitor charges at the second and faster rate, which rate is, for example, approximately three times thefirst rate. This second charge rate continues until switch 165 opens at which time the rate exponentially decays back to the first rate. The decay rate is determined by the values of resistor R56 and capacitor C18. Because discharge of capacitor C6 is controlled by comparator 58, as described, the pulse width of the timing signal elements produced at junction 57 is maintained substantially constant regardless of the charge rate of capacitor C6 or the repetition rate at which the timing signal elements are produced.

The rate at whichtiming signal elements are generated may also be a function of the state of detector 35 or which signal element of second electrical signal S2 is supplied by comparator 39. Thus, for example, a resistor R60 and a potentiometer 167 may be optionally connected between the input to gate G1 and the non-inverting input of comparator 58. Thus, when the air-fuel mixture is lean, as sensed by detector 35, and a first signal element of the second electrical signal is supplied at the output of comparator 39, current flows through resistor R60 and potentiometer 167 from the comparator and lowers the capacitor C6 charging current and the rate at which timing signal elements are produced. When detector 35 senses a rich mixture and a second signal element of the second electrical signal is supplied at the output of comparator 39, the current flow through resistor R60 and the potentiometer is reversed and the rate at which capacitor C6 is charged increases. Consequently, a bias toward a leaner air-fuel mixture is created since the response of the apparatus is slower when a lean mixture is sensed. By connecting a resistor R60A between the output of inverter gate G1 and potentiometer 167 instead of connecting resistor R60 at the gate input, the opposite result is produced with the bias now toward a richer mixture.

When engine E is not started for some period of time after it is shut down, a cold start condition exists in which the operating temperature of detector 35 is initially less than some preselected value, for example 400° C. (752° F.). In such a situation, it is desirable not to change the control signal supplied to air metering unit 17 until the detector temperature rises above the preselected value. Since detector 35 has a temperature-dependent internal impedance, circuitry for preventing a change in the control signal comprises a bridge network 169 with the detector impedance included in one leg of the bridge and with another leg of the bridge including an impedance whose value is a function of the detector impedance at the preselected value. One-half of bridge 169 includes the impedance of detector 35, resistor R1 and capacitor C1 and a resistor R61 and a pair of capacitors C19 an C20 respectively. The other half of the bridge comprises a pair of resistors R62 and R63 and the bridge is substantially balanced when the detector temperature is at the preselected value. The bridge output is connected to a comparator 171 (an operational amplifier) which includes a pull-up resistor R64. Comparator 171 supplies first and second signal elements of a bridge output signal to one input of gate G2. A first signal element of the bridge output signal (a logic high) is supplied by comparator 171 when the detector temperature is above the preselected value and a second element (a logic low) is supplied when the detector temperature is below the preselected value. When a timing signal element is generated, a pulse is produced by bridge 169 and provided to the non-inverting input of comparator 171. This pulse is a negative going pulse whose amplitude is determined by the internal impedance of detector 35 and compared with the reference voltage at the inverting input to the comparator.

The other input to gate G2 is supplied with elements of an enabling signal. An enabling signal element is produced each time a timing signal element is generated. The circuitry for producing an enabling signal element includes a pair of resistors R65 and R66 respectively, a diode D9 and a capacitor C21. One side of capacitor C21 is connected to the output of inverter G7 which, as previously noted, inverts the timing signal produced at junction 57. Thus, the logic output of gate G7 is normally low but goes high during the period an element of the timing signal is produced. As a consequence, an element of the enabling signal is produced at the trailing edge of a timing signal element and is a momentary high-to-low transition at the input to gate G2.

If a first signal element of the bridge output signal is present at the input to gate G2 when an enabling signal element is supplied to the gate, the logic output of the gate is low. As previously described, the output of gate G2 is connected to display counter 53 and specifically to the set input of flip-flop FF1 and the reset input of flip-flop FF2. A logic low supplied by gate G2 to counter 53 has no effect on the counter. If, however, a second signal element of the bridge output signal is supplied to gate G2 when an enabling signal element is supplied, it indicates that the temperature of detector 35 is below the threshold level and a logic high is supplied by the gate to counter 53 and the counter is reset. Thus, until the detector temperature exceeds the predetermined value, counter 53 is reset each time a timing signal element, which normally increments counter 53, is generated. Therefore, the contents of counter 53 cannot reach the value of two which is necessary in order for controller 41 to accept timing signal elements and produce a change in the control signal supplied to air metering unit 17.

Besides not wanting to change the control signal supplied to air metering unit 17 during a cold start, it is also desirable to hold off or prevent a change in the control signal at other times, as for example, during heavy accelerations (wide-open throttle). For this purpose, a hold off switch 173 is closed whenever a particular engine operating condition is created during which no change in the control signal is to be produced. When switch 173 is closed, the non-inverting input of comparator 171 is effectively grounded through a circuit which includes resistors R67, R68 and R69 and a capacitor C22. With the non-inverting input of the comparator grounded, a second signal element of the bridge output signal is supplied to gate G2 and results in the gate supplying a logic high to delay counter 53 whenever an enabling signal element is supplied to the gate. Counter 53 is reset by the logic high from gate G2 and continues to be so until switch 173 opens.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

We claim:

1. Apparatus for controlling the air-fuel ratio in an internal combustion engine to substantially maintain the ratio at the stoichiometric point while the engine is operating under various load conditions, the engine having a carburetor with at least one air passageway therein through which air is drawn into the engine, fuel from a source thereof being supplied to the carburetor through at least one fuel system and mixed with the air as it passes through said carburetor, said carburetor having a conduit through which air is introduced into said system, and the engine further having a chamber for combustion of the resulting air-fuel mixture and means for exhausting the products of said combustion, the apparatus comprising:

means for metering the quantity of air introduced into the fuel system through said conduit thereby to control the air-fuel ratio of the mixture;

an oxygen sensor for sensing the presence of oxygen in the products of combustion and for supplying a first electrical signal representative of the oxygen content therein, said oxygen content being a function of the air-fuel ratio of the mixture;

means for comparing the first electrical signal with a predetermined reference level which is a function of said stoichiometric point to produce a second electrical signal having first and second signal elements, a first signal element being produced when the air-fuel ratio of the mixture is greater than the predetermined level and a second signal element being produced when the ratio is less than the level, the comparing means comprising a voltage comparator having one input to which is applied the first electrical signal, a second input to which is applied a reference voltage whose amplitude is a function of the oxygen content in the products of combustion at the stoichiometric point and an output from which is supplied the first and second signal elements of the second electrical signal, a first signal element being supplied by the comparator when the first electrical signal amplitude is less than the reference voltage amplitude, a second signal element being supplied when the first electrical signal amplitude exceeds the reference voltage amplitude and a transition from one signal element to the other occurring whenever the first electrical signal amplitude changes from greater to less than the reference voltage amplitude and vice versa;

control means responsive to the second electrical signal for supplying to the metering means a control signal by which the quantity of air introduced into the conduit is controlled and for producing a change in the control signal whenever the second electrical signal has a transition from one signal element to the other thereby for the metering means to change the quantity of air introduced into the conduit by an amount necessary to substantially maintain the air-fuel ratio at the predetermined value and the control means including a reversible accumulating control counter and counter control means responsive to the first and second signal elements of the second electrical signal for incrementing and decrementing the contents of the control counter, said contents being incremented when less air is to be introduced into the conduit and the mixture made richer and decremented when more air is to be introduced into the conduit and the mixture made leaner, the counter control means including first, second, and third logic gates, the first and second logic gates each having a common input, the first logic gate having a second input to which is supplied the first and second signal elements of the second electrical signal and the first logic gate having an output which is connected through an inverter to a count direction input of the reversible accumulating counter, and the second logic gate having as a second input a timing signal, elements of the timing signal being used to change the contents of the reversible accumulating counter, and an output of the second logic gate being connected to a first input of the third logic gate, the third logic gate having a second input to which is supplied a count inhibit signal from the reversible accumulating counter, the inhibit signal being generated when the reversible accumulating counter reaches either an upper or lower count limit, and the output of the third logic gate being supplied to a count input of the reversible accumulating counter; and means for sampling the second electrical signal over a predetermined time interval starting when a signal element of the second electrical signal is produced to determine whether a transition between signal elements occurs within said time interval, the control means being responsive to the sampling means to produce a change in the control signal if no transition occurs within said time interval whereby the quantity of air introduced into the conduit is changed, but to produce no change in the control signal if a transition does occur within the predetermined time interval whereby the quantity of air introduced into the conduit remains unchanged, the sampling means including time-delay means responsive to timing signal elements for counting from zero to a preselected value and for inhibiting the counter control means from incrementing or decrementing the contents of the reversible accumulating counter until the preselected value is reached, the time-delay means including a delay-counter comprised of a pair of flip-flops, the output of one flip-flop being connected to an input of the second flip-flop and the output of the second flip-flop being connected to the common inputs of the first and second logic gates of the counter control means, and the sampling means further including delay-counter reset circuitry responsive to the signal elements of the second electrical signal for resetting the contents of the delay-counter whenever a transition occurs between first and second elements of the second electrical signal.

2. Apparatus as set forth in claim 1 wherein the metering means includes an air metering unit having an air inlet, an air outlet communicating with said conduit, a metering pin insertable into and withdrawable from the air outlet to control the quantity of air admitted into the conduit and means responsive to the control signal for positioning the metering pin in the air outlet.

3. Apparatus as set forth in claim 2 wherein the carburetor includes a second fuel system and a second conduit through which air is introduced into said second fuel system and the air metering unit includes a second air outlet communicating with said second conduit and a second metering pin insertable into and withdrawable from said second air outlet to vary the quantity of air admitted into the second conduit through the second opening, the positioning means simultaneously positioning the first and second metering pins in their respective air outlets in response to the control signal.

4. Apparatus as set forth in claim 1 wherein the control means further includes interface means responsive to a digital signal supplied by the control counter for producing the control signal supplied to the air metering means and for producing a change in the control signal when the value of the contents of the control counter, as represented by the digital signal, change.

5 Apparatus as set forth in claim 4 wherein the timing means includes means for generating elements of the timing signal at a first repetition rate when the engine is operating under steady state conditions and at a second and faster repetition rate when a non-steady state condition is created such as when engine acceleration or deceleration occurs thereby to increase response time of the apparatus during a non-steady state operating condition.

6. Apparatus as set forth in claim 5 wherein the timing means includes a timing capacitor, means for charging said capacitor at a first rate when steady state conditions exist and at a second and faster rate when non-steady state conditions occur, the repetition rate of the timing signal elements generated being a function of the capacitor charging rate, means for discharging the capacitor at a predetermined rate, the pulse width of each timing signal element generated being a function of the capacitor discharge rate, and means responsive to the charge level of the timing capacitor reaching a predetermined level to actuate the discharging means thereby to produce a timing signal element the pulse width of which is maintained substantially constant regardless of the repetition rate at which it is generated.

7. Apparatus as set forth in claim 4 further including means responsive to the temperature of the oxygen detector to prevent a change in the control signal supplied to the metering means whenever the detector temperature is less than a preselected value.

8. Apparatus as set forth in claim 7 wherein the oxygen detector has a temperature dependent internal impedance and the change prevention means comprises a bridge network one leg of which includes the detector internal impedance and another leg of which includes an impedance whose value is a function of the detector internal impedance at the preselected temperature value whereby the bridge is substantially balanced when the temperature of the detector is at the preselected value.

9. Apparatus as set forth in claim 8 wherein the change prevention means further includes means for comparing a signal developed across said legs of the bridge to determine if the detector temperature is above or below the preselected value and for supplying first and second signal elements of a bridge output signal, a first signal element of the bridge output signal being supplied when the detector temperature is above the preselected value and a second signal element being supplied when the detector temperature is below the preselected value.

10. Apparatus as set forth in claim 9 wherein the change prevention means further comprises means responsive to the bridge output signal for preventing the value of the delay counter contents from reaching two when the detector temperature is below the preselected value.

11. Apparatus as set forth in claim 10 wherein the change prevention means further comprises a reset logic gate having one input to which is applied the first and second signal elements of the bridge output signal, a second input to which is applied an element of an enabling signal which is produced when an element of the timing signal is generated and an output from which a signal is supplied to the reset input of the delay counter to reset the contents of said delay counter to zero if a second signal element of the bridge output signal is supplied to the one input of the reset logic gate when an element of the enabling signal is supplied to its second input.

12. Apparatus as set forth in claim 11 further including hold off means for preventing a change in the control signal.

13. Apparatus as set forth in claim 12 wherein the hold off means includes means for grounding one input to the comparing means of the change prevention means whereby a second signal element of bridge output signal is continuously supplied to the one input of the reset logic gate and the delay counter is continuously reset.

* * * * *